US011040358B2

(12) United States Patent
Sesser et al.

(10) Patent No.: US 11,040,358 B2
(45) Date of Patent: Jun. 22, 2021

(54) RIGID MOUNT ORBITOR SPRINKLER WITH SPIDER REFUGE

(71) Applicant: Nelson Irrigation Corporation, Walla Walla, WA (US)

(72) Inventors: George L. Sesser, Walla Walla, WA (US); Craig B. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 155 days.

(21) Appl. No.: 16/118,718

(22) Filed: Aug. 31, 2018

(65) Prior Publication Data

US 2019/0054480 A1 Feb. 21, 2019

Related U.S. Application Data

(63) Continuation-in-part of application No. 15/946,382, filed on Apr. 5, 2018.

(60) Provisional application No. 62/547,989, filed on Aug. 21, 2017.

(51) Int. Cl.

| | |
|---|---|
| ***B05B 3/00*** | (2006.01) |
| ***B05B 3/04*** | (2006.01) |
| *B05B 1/18* | (2006.01) |

(52) U.S. Cl.

CPC ..... *B05B 3/008* (2013.01); *B05B 3/003* (2013.01); *B05B 3/0486* (2013.01); *B05B 1/18* (2013.01)

(58) Field of Classification Search

CPC ..... B05B 3/0486; B05B 3/003; B05B 3/008; B05B 15/18

USPC ..... 239/222.17

See application file for complete search history.

(56) References Cited

U.S. PATENT DOCUMENTS

| | | | | |
|---|---|---|---|---|
| 2,151,214 | A * | 3/1939 | Kramer | B05B 1/28 239/443 |
| 2,186,786 | A * | 1/1940 | Jensen | D06F 13/08 74/18.1 |
| 2,622,927 | A * | 12/1952 | Sarbu | B05B 3/0427 239/240 |
| 2,639,191 | A * | 5/1953 | Hruby, Jr. | B05B 3/0445 239/231 |
| 3,009,648 | A | 11/1961 | Hait | |
| 3,034,728 | A | 5/1962 | Hruby, Jr. | |
| 3,091,400 | A | 5/1963 | Aubert | |
| 4,487,368 | A | 12/1984 | Clearman | |

(Continued)

FOREIGN PATENT DOCUMENTS

| | | |
|---|---|---|
| CN | 104069967 | 9/2017 |

OTHER PUBLICATIONS

European Extended Search Report dated Feb. 7, 2020 issued in European Patent Application No. 19191088.4, 9 pp.

(Continued)

*Primary Examiner* — Chee-Chong Lee

(74) *Attorney, Agent, or Firm* — Nixon & Vanderhye P.C.

(57) ABSTRACT

A rigid mount orbitor sprinkler assembly incorporates a deflector plate configuration that is configured for both spinning/rotating motion as well as orbital or wobbling motion around the center of a spool assembly. The sprinkler includes a spider ingress opening cooperable with a spider barrier that in combination permit inevitable spider ingress while preventing spider access or contact with certain moving parts of the sprinkler.

19 Claims, 25 Drawing Sheets

(56) References Cited

U.S. PATENT DOCUMENTS

| | | | | |
|---|---|---|---|---|
| 4,802,628 | A | 2/1989 | Dautel | |
| 5,439,174 | A | 8/1995 | Sweet | |
| 5,588,595 | A | 12/1996 | Sweet et al. | |
| 5,671,885 | A | 9/1997 | Davisson | |
| 5,950,927 | A | 9/1999 | Elliott et al. | |
| 6,186,414 | B1 | 2/2001 | Clearman et al. | |
| 6,199,771 | B1 * | 3/2001 | Clearman | B05B 3/008 239/222.11 |
| 6,439,477 | B1 | 8/2002 | Sweet et al. | |
| 6,932,279 | B2 | 8/2005 | Burcham | |
| 7,942,345 | B2 | 5/2011 | Sesser | |
| 8,991,724 | B2 * | 3/2015 | Sesser | B05B 3/005 239/222.21 |

OTHER PUBLICATIONS

Australian Examination Report No. 1 dated Feb. 6, 2020 issued in Australian Patent Application No. 2019206122, 6 pp.
U.S. Office Action dated Mar. 25, 2020 issued in U.S. Appl. No. 15/946,382, 24 pp.

* cited by examiner

RIGID MOUNT ORBITOR SPRINKLER WITH SPIDER REFUGE

CROSS-REFERENCES TO RELATED APPLICATIONS

This application is a continuation-in-part (CIP) of U.S. patent application Ser. No. 15/946,382, filed Apr. 5, 2018, pending, which claims the benefit of U.S. Provisional Patent Application No. 62/547,989, filed Aug. 21, 2017, the entire contents of each of which are hereby incorporated by reference in this application.

STATEMENT REGARDING FEDERALLY SPONSERED RESEARCH OR DEVELOPMENT (NOT APPLICABLE)

BACKGROUND

The invention relates to a rotating/wobbling sprinkler assembly and, more particularly, to a sprinkler that can be rigidly mounted on a center pivot (or other support structure) that disperses water using a spinning or rotating deflector plate and with orbital motion of the deflector plate assembly.

Moving irrigation systems such as conventional pivot or linear systems are known to incorporate conduit truss span assemblies that mount sprinkler heads, spaced along the truss assemblies for sprinkling or irrigating relatively large areas of land. The sprinkler heads may be mounted on top of the truss assemblies in a normal upright position, or they may be inverted and suspended from the span assemblies by means of drop tubes. Sprinkler heads are typically of the spinner type, which incorporate rotatable stream distributors (also referred to as rotor plates or spray plates, fixed spray plates or bubbler devices).

When irrigating large areas of land with pivot or linear sprinklers, the sprinklers need to be spaced apart as far as possible to minimize system hardware costs. Obtaining an even distribution of the water at wide spacings requires sprinklers that simultaneously throw the water long distances and produce sprinkling patterns that are even when overlapped with adjacent sprinklers. These two requirements are somewhat exclusive in that maximum radius of throw is achieved with concentrated streams of water shooting at relatively high trajectory angles. These streams, however, tend to produce a donut-shaped sprinkling pattern at low pressure that does not overlap evenly. The use of nutating or wobbling sprinklers to enhance distribution uniformity particularly at low pressure is known in the art, as evidenced, for example, by U.S. Pat. Nos. 5,439,174; 5,671,885; 5,588,595; 5,950,927; 6,439,477; and 6,932,279. Wobbling type sprinklers can be problematic, however, in the sense that in some circumstances, the sprinkler simply rotates on its center axis without wobbling. This is particularly true if the sprinkler rotor plate is allowed to assume an on-center orientation when at rest.

There is a need for a sprinkler that can be rigidly mounted on a center pivot (or other support structure) that disperses the water in a combined rotating and wobbling manner. The existing designs have to be mounted on a damping device such as a 2' minimum length drop hose to isolate the structure from the damaging vibration. Orbiting (or nutating or wobbling) sprinklers normally operate in the range of 1000-2400 orbits/min. The load from the deflected stream reverses direction at that speed, thus being the primary cause of vibration, but the mass and balance of the orbiting parts also affect the vibration. The magnitude of the vibration that reaches the structure is important, but it is also important that the frequency of the vibration not match up with the resonant frequency of the structure.

BRIEF SUMMARY

A rigid mount orbitor sprinkler assembly incorporates a deflector plate configuration that is configured for both spinning/rotating motion as well as orbital or wobbling motion around the center of a spool assembly. The sprinkler incorporates structure to reduce drool that may fall in a concentrated area below the sprinkler and to prevent debris from sandy water or the like from accelerating sprinkler component wear. With reduced vibration, the assembly may be rigidly mounted on a center pivot or other supporting structure while achieving the advantages associated with wobbling and rotating sprinkler assemblies.

In an exemplary embodiment, a sprinkler includes a sprinkler body, a nozzle associated with one end of the sprinkler body, and a cap secured to or integral with an opposite end of the sprinkler body. The cap includes a central opening and at least one spider ingress opening, preferably three, positioned radially outward of the central opening. A deflector plate assembly supported by the cap includes a deflector plate at an upstream end facing the nozzle, a spool assembly supported in the central opening of the cap, and a counterbalance weight at a downstream end. The deflector plate assembly is pitched at an angle relative to the sprinkler body. A spider barrier disposed in engagement with the cap defines an enclosure over the at least one spider ingress opening.

The cap may include a lower ledge radially outward of the central opening, where the at least one spider ingress is provided in the lower ledge. The cap may also include an upper ledge radially outward of the lower ledge. The spider barrier may include an inner wall connected with an outer wall with a space in between. In this context, the inner wall may engage the lower ledge and the outer wall may engage the upper ledge such that the space between the inner and outer walls is positioned over the at least one spider ingress opening. The inner wall may be tapered to accommodate orbital motion of the deflector plate assembly.

The sprinkler may also include a sprinkler head cover positioned over the counterbalance weight and secured to the cap. In some embodiments, the cap may include an outer ledge radially outward of the upper ledge, where the sprinkler head cover is secured to the outer ledge.

The spider barrier may be substantially V-shaped in cross section.

The spider barrier may be sized and positioned to create a space while blocking access to moving parts of the sprinkler on a downstream side of the cap.

In another exemplary embodiment, a sprinkler includes a sprinkler body having a longitudinal axis, a cap secured to or integral with the sprinkler body and including a central opening and at least one spider ingress opening positioned radially outward of the central opening, a nozzle, and a deflector plate assembly including a deflector plate at one end disposed facing the nozzle, a counterbalance weight disposed at an opposite end, and a spool assembly positioned in the central opening and disposed between the deflector plate and the counterbalance weight. A spider barrier may be disposed in engagement with the cap and may define an enclosure over the at least one spider ingress opening. The deflector plate assembly may be rotatable about a rotation axis, where the deflector plate assembly is supported in the sprinkler body such that the rotation axis is pitched relative to the longitudinal axis and such that the deflector plate assembly is configured to wobble about the longitudinal axis. The spider barrier may be shaped to accommodate the wobble of the deflector plate assembly about the longitudinal axis.

In yet another exemplary embodiment, a sprinkler includes a sprinkler body, a nozzle associated with one end of the sprinkler body, and a deflector plate assembly supported in the sprinkler body. The deflector plate assembly includes a deflector plate at an upstream end facing the nozzle and a counterbalance weight at a downstream end. At least one spider ingress opening is disposed adjacent the deflector plate assembly. A spider barrier defines an enclosure over the at least one spider ingress opening. The spider barrier is configured to permit spider ingress while preventing spider access or contact with parts of the deflector plate assembly.

BRIEF DESCRIPTION OF THE DRAWINGS

These and other aspects and advantages will be described in detail with reference to the accompanying drawings, in which.

DETAILED DESCRIPTION

Figure 1:
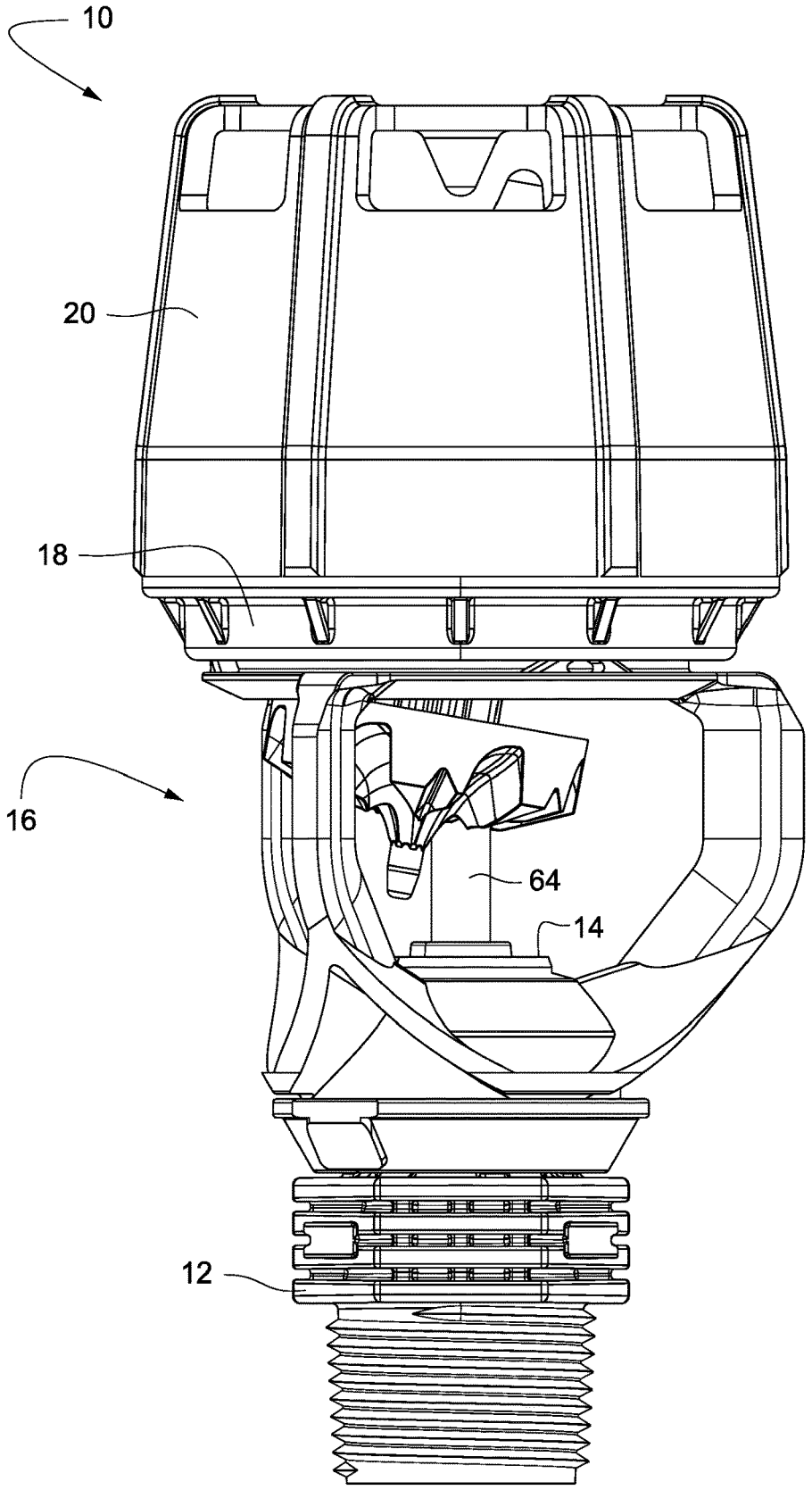
FIG. 1 shows an assembled sprinkler head of a first embodiment.
Figure 2:
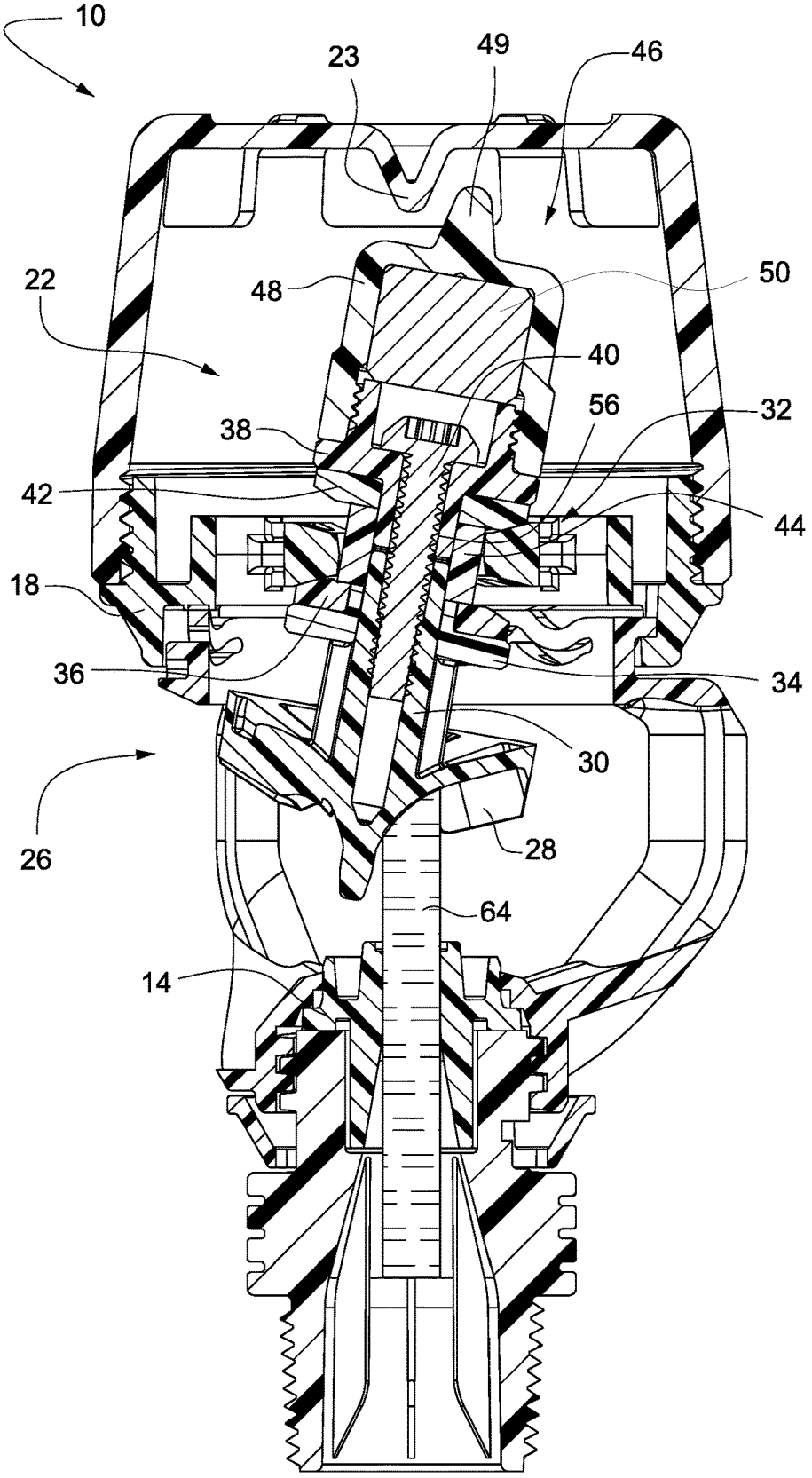
FIGS. 2 and 3 are cross-sectional views of the sprinkler head of FIG. 1.
Figure 3:
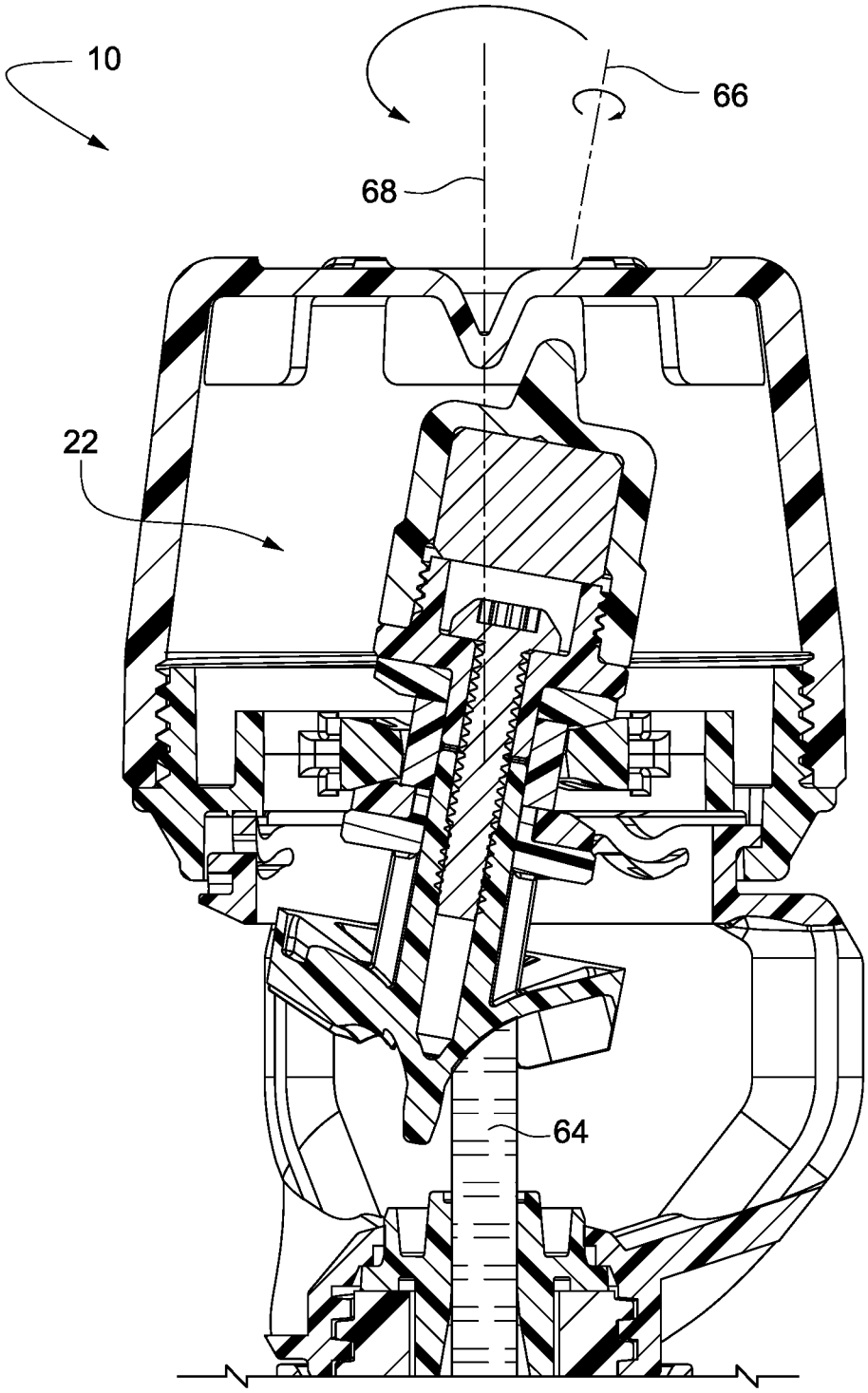
Figure 13:
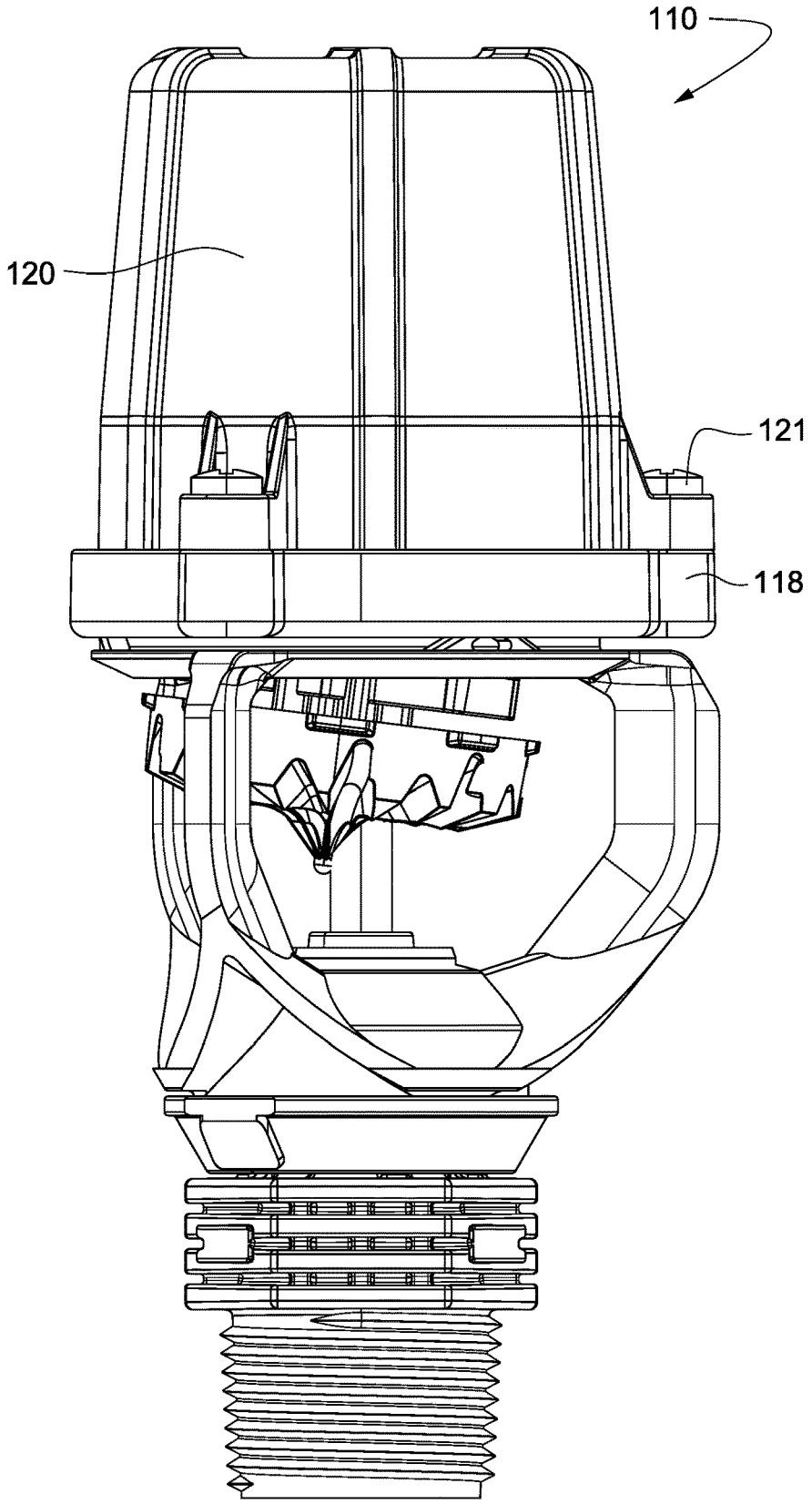
FIG. 13 shows an alternative embodiment of the sprinkler head.

FIGS. 1-3 show a rigid mount orbiter sprinkler assembly 10 according to one embodiment. The assembly 10 is connectable to a source of water under pressure via an inlet 12. The inlet 12 may be threaded or otherwise securely connected to the water source (not shown). Water flow is directed through a nozzle 14 secured in a sprinkler body 16. A cap 18 is connected with the sprinkler body 16, and a sprinkler head cover 20 is secured to the cap 18. The cap 18 may be secured to the sprinkler body 16 in any suitable manner, which includes being formed integral with the sprinkler body 16. In some embodiments, the cap 18 includes locking structure 19 (see FIG. 6) for a twist lock or bayonet-type lock to complementary components on the sprinkler body 16. The cap 18 may also include threads 21 for securing the sprinkler head cover 20. The cap 18 may alternatively be secured to the body 16 with screws or the like (see e.g., FIG. 13).

With reference to FIGS. 2, 3 and 6-10, a deflector plate assembly 22 is supported for rotation/spinning and orbital motion in a central opening 24 (see FIG. 6) in the cap 18. The deflector plate assembly 22 includes a deflector plate member 26 at an upstream end having a deflector plate 28 on an upstream side facing the nozzle 14 and a splined shaft 30 on a downstream side. As shown in more detail in FIG. 7, the deflector plate 28 of the deflector plate member 26 includes lands and grooves that are configured to disperse water impacting the deflector plate 28 in a predefined pattern and to impart rotation and orbital motion of the deflector plate assembly 22 by impact with the water stream.

The deflector plate assembly 22 also includes a spool assembly 32 supported in the central opening 24 of the cap 18. The spool assembly includes an upstream spool shoulder 34 secured over the splined shaft 30 of the deflector plate member 26. An upstream flange 36 is positioned adjacent the upstream spool shoulder 34. A downstream spool shoulder 38 is connected to the splined shaft 30 by a bolt 40 or the like. A downstream flange 42 is positioned adjacent the downstream spool shoulder 38. The flanges 36, 42 may be elastomer flanges and may be provided with lugs or splines to engage and rotate with the upstream 34 and downstream 38 spool shoulders. A bushing 44 engages the upstream 34 and downstream 38 spool shoulders and is interposed between the flanges 36, 42.

The deflector plate assembly 22 also includes a counterbalance weight assembly 46 at a downstream end. The counterbalance weight assembly 46 includes a housing 48 secured to the downstream spool shoulder 38 and a counterbalance weight 50 disposed in the housing 48.

As shown, the deflector plate assembly 22 is pitched at an angle relative to the sprinkler body 16. The cover 20 may be provided with a pitch member 23 disposed facing the housing 48. The housing 48 may be provided with a tab member 49 at a distal end. The pitch member 23 and the tab member 49 cooperate to maintain the deflector plate assembly 22 in the central opening 24 at the angle relative to the sprinkler body 16.

Figure 8:
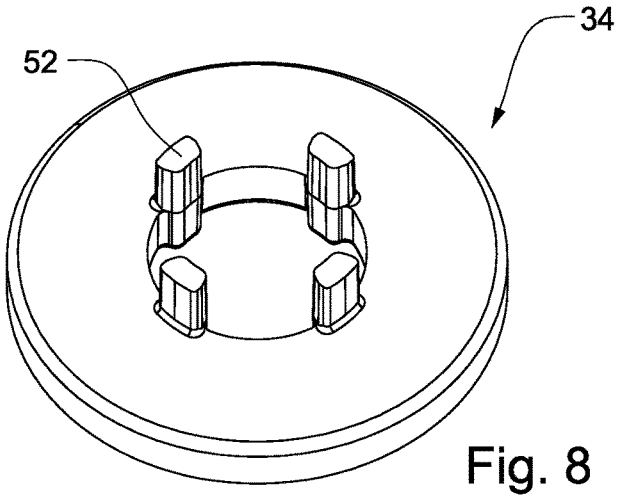
Figure 9:
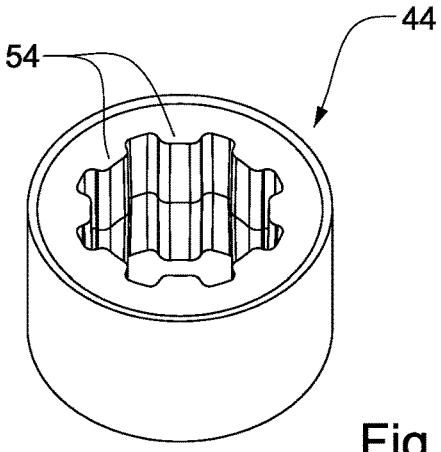
Figure 10:
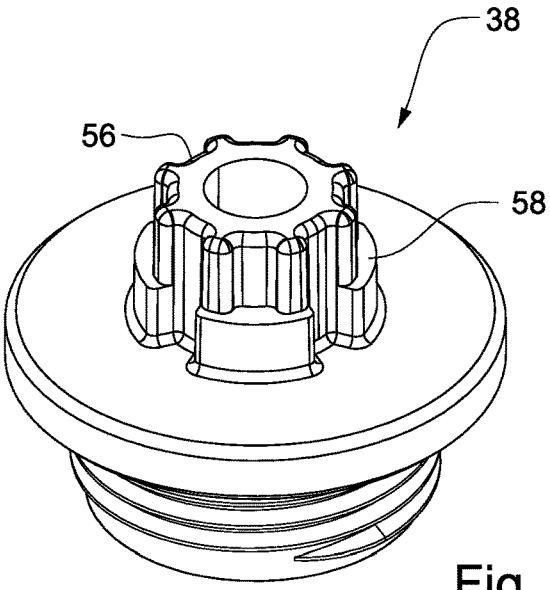

Parts of the deflector plate assembly 22 are shown in FIGS. 6-10. FIG. 8 shows the upstream spool shoulder 34, which includes lugs 52 for engaging the splined shaft 30 of the deflector plate member 26. As shown, the lugs 52 protrude (upwardly in FIG. 8) to engage the bushing 44. With reference to FIG. 9, the bushing 44 similarly includes lugs 54 for engaging the splined shaft 30 of the deflector plate member 26. With reference to FIG. 10, the downstream spool shoulder 38 includes a shaft 56 that is splined generally corresponding to the splined shaft 30 of the deflector plate member 26. As shown in FIGS. 2 and 3, the downstream spool shoulder 38 may be abutted against and aligned with the splined shaft 30. Together, the splined shaft 30 and the shaft 56 of the downstream spool shoulder 38 define a spool shaft between the facing spool shoulders 34, 38. Lugs 58 are provided around the shaft 56 and are positioned to engage the bushing 44 when assembled. In some embodiments, the upstream spool shoulder 34, the downstream spool shoulder 38 and the bushing 44 are molded from hard plastic, and the upstream flange 36 and the downstream flange 42 are formed of an elastomer or other pliable material. When assembled, the bolt 40 compresses the components together with the bushing 44 engaged by the hard plastic lugs 52 and 58 of the respective upstream 34 and downstream 38 spool shoulders so as not to overly compress and distort the elastomer flanges 36, 42 while securing the flanges in place.

Figure 6:
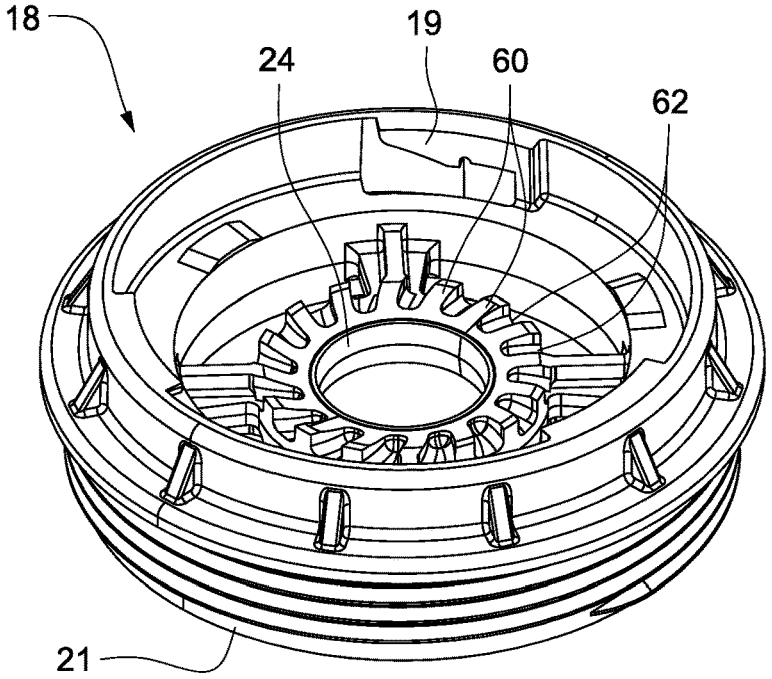
FIGS. 6-10 are perspective views of various parts of the assembly.
Figure 7:
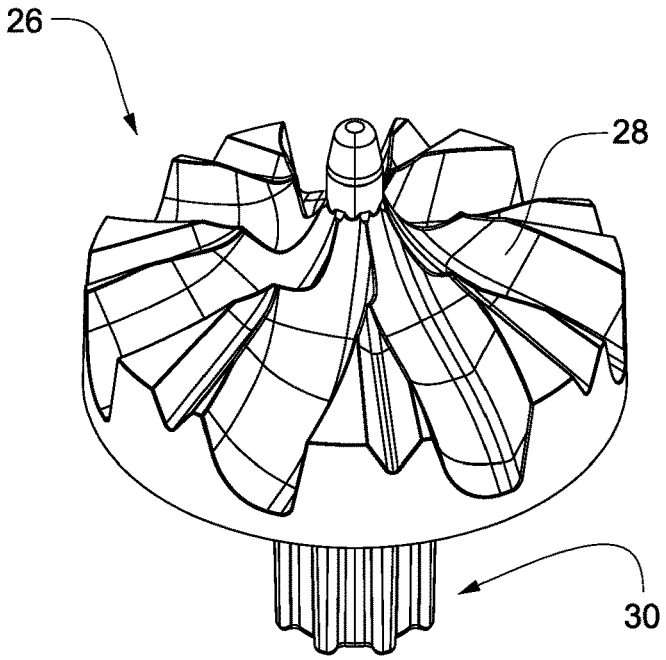

With reference to FIGS. 2, 3 and 6, the cap 18 is provided with traction surfaces surrounding the central opening 24. In particular, the traction surfaces may include traction bars 60 and debris pockets 62 interposed between the traction bars 60 and positioned circumferentially around the central opening 24 of the cap 18. In use, the flanges 36, 42, which are preferably formed of a soft elastomer material, engage the traction surfaces to facilitate rotation of the deflector plate assembly 22. That is, the flanges 36, 42 are driven into engagement with the traction bars 60 for a secure grip. The debris pockets 62 serve to accumulate any debris such as sand or the like that may get into the spool assembly 32. The accumulated debris in the debris pockets 62 will ultimately work its way out during use.

In operation, a water stream 64 is emitted from the nozzle 14 and impacts the deflector plate 28 of the deflector plate assembly 22. As the water stream 64 impacts the deflector plate 28, the deflector plate assembly 22 is caused to rotate or spin about its longitudinal axis or rotation axis 66 (FIG. 3). Additionally, because the deflector plate assembly 22 is pitched relative to the sprinkler body by the spool assembly 32 supported in the central opening 24 of the cap 18, the deflector plate assembly 22 is also caused to wobble by orbital motion around a central axis 68 of the spool assembly 32.

Figure 4:
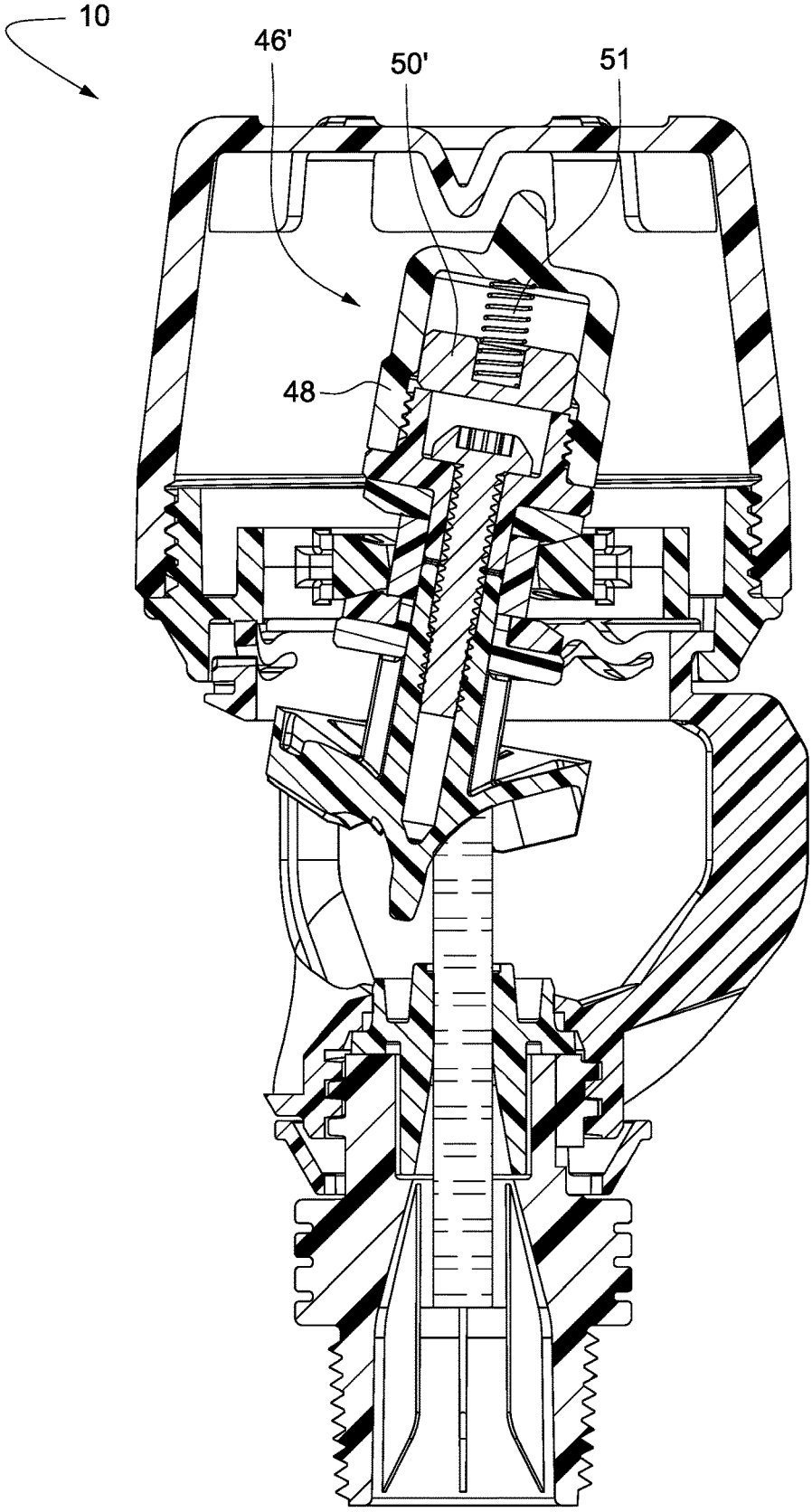
FIGS. 4 and 5 show a variation of the counterbalance weight.
Figure 5:
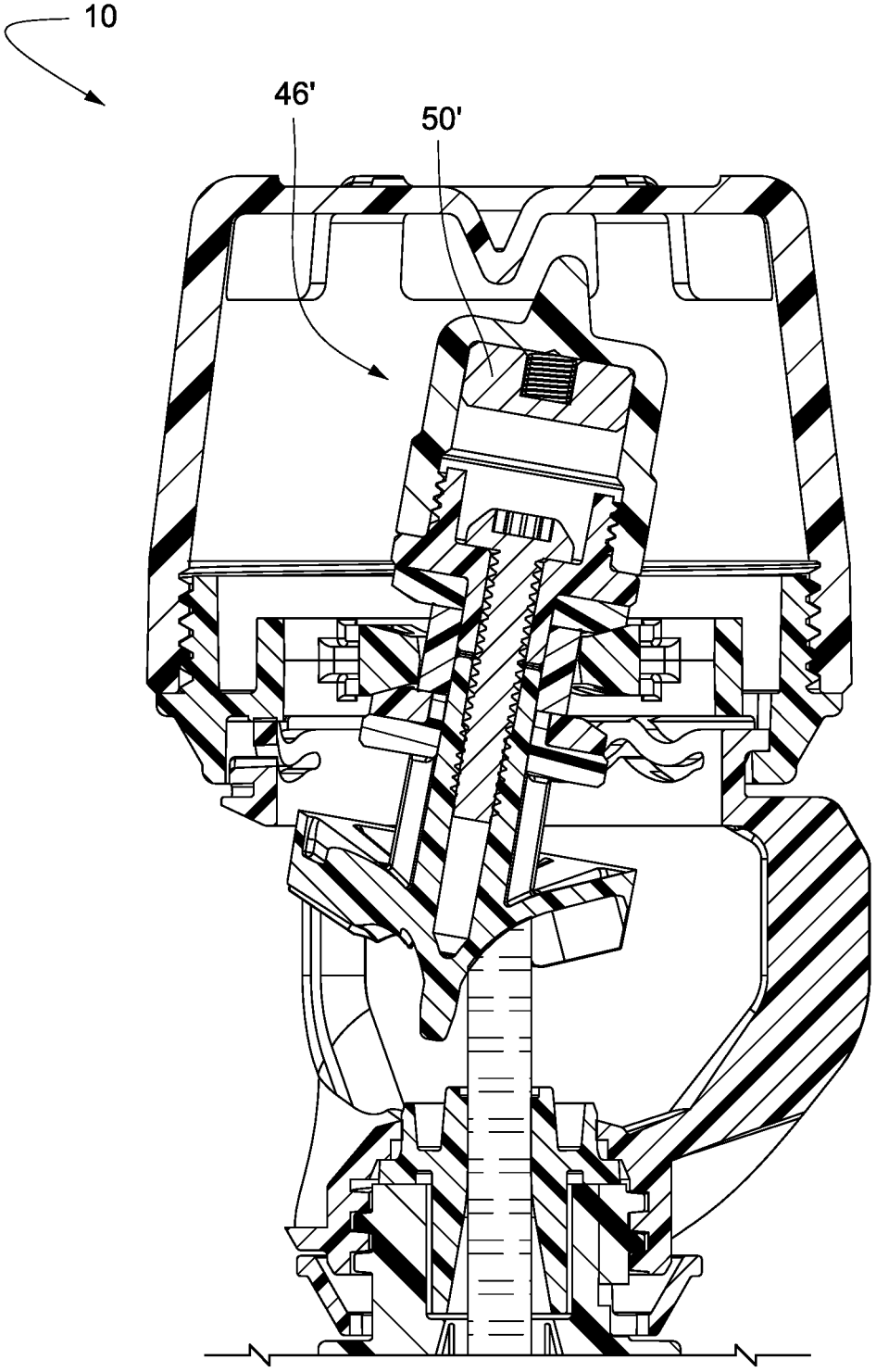

FIGS. 4 and 5 show a variation of the counterbalance weight assembly 46'. As shown, the counterbalance weight 50' is displaceable in the housing 48 between a low-speed retracted position (FIG. 4) and a high-speed extended position (FIG. 5). A spring 51 is interposed between the counterbalance weight 50' and the housing 48 and biases the counterbalance weight 50' toward the low-speed retracted position. In use, as the orbital motion speed of the deflector plate assembly 22 increases (i.e., orbital motion or wobble about axis 68), the counterbalance weight 50' is displaced toward the high-speed extended position against the force of the spring 51. Deflection of the counterbalance weight 50' will slow the orbital motion speed until the counterbalance weight 50' reaches the high-speed extended position (adjacent an outermost wall of the housing 48 as shown in FIG. 5).

Figure 11:
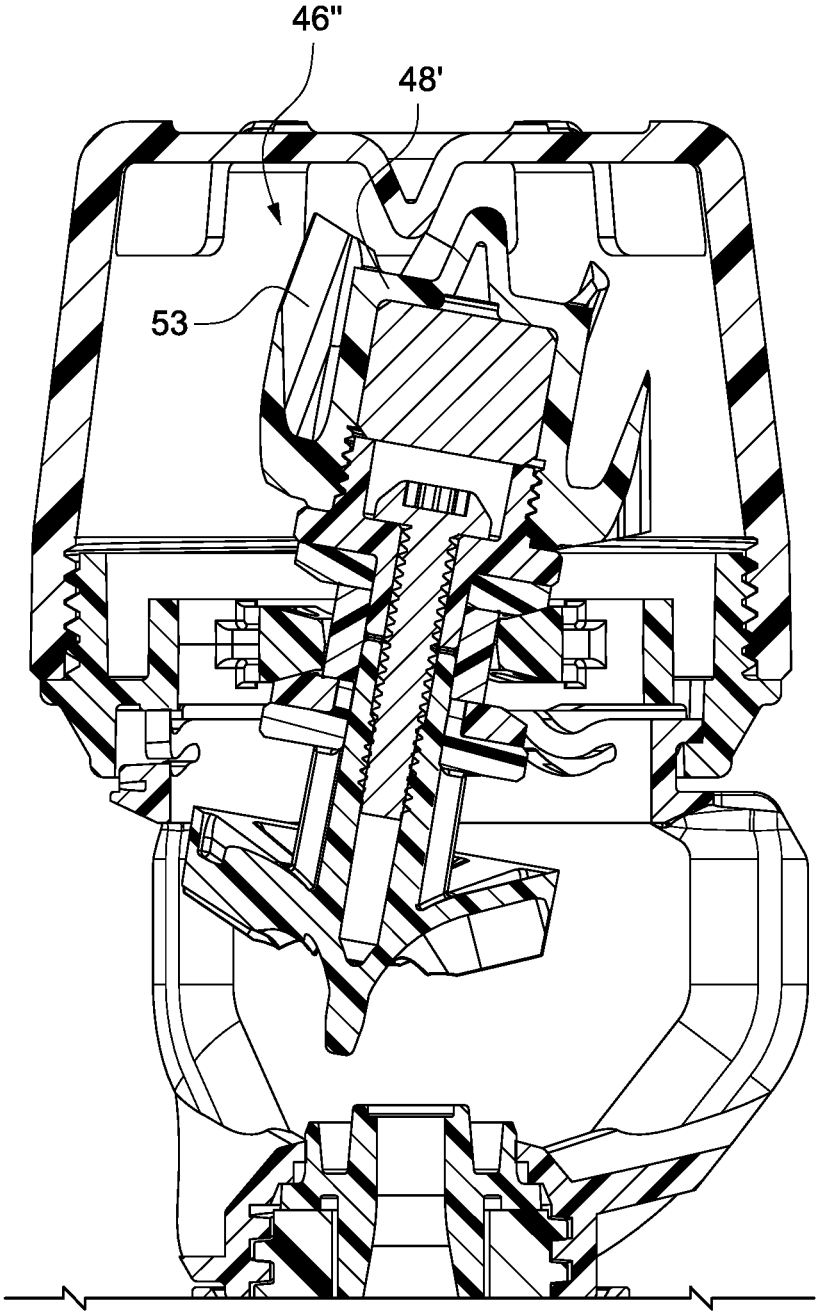
FIGS. 11 and 12 show a variation of the counterbalance weight housing.
Figure 12:
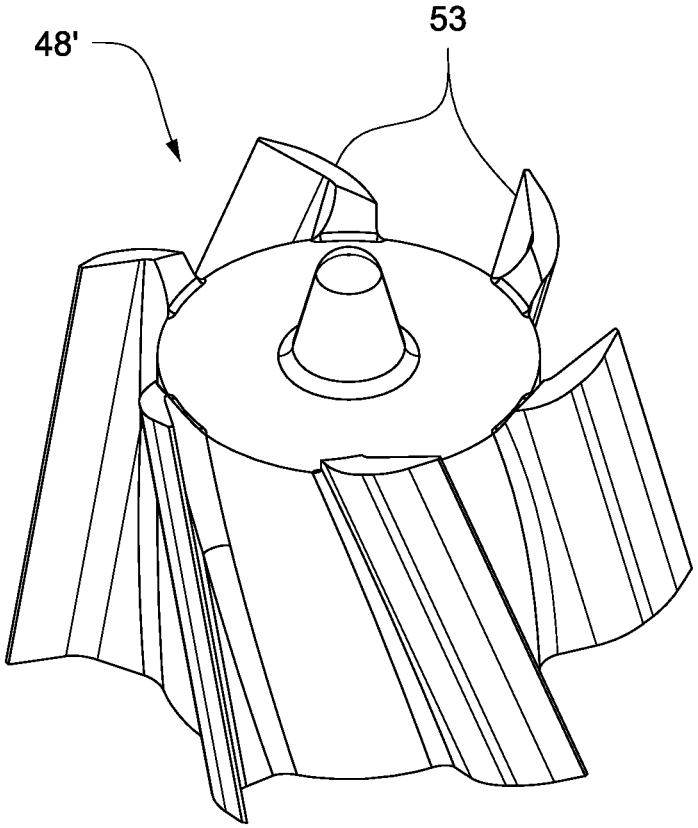

FIGS. 11 and 12 show yet another variation of the counterbalance weight assembly 46". In this variation, the housing 48' is provided with fan blades 53. The fan blades 53 act as dampers (e.g., air dampers) to slow the orbital motion of the deflector plate assembly 22 about axis 68.

Figure 14:
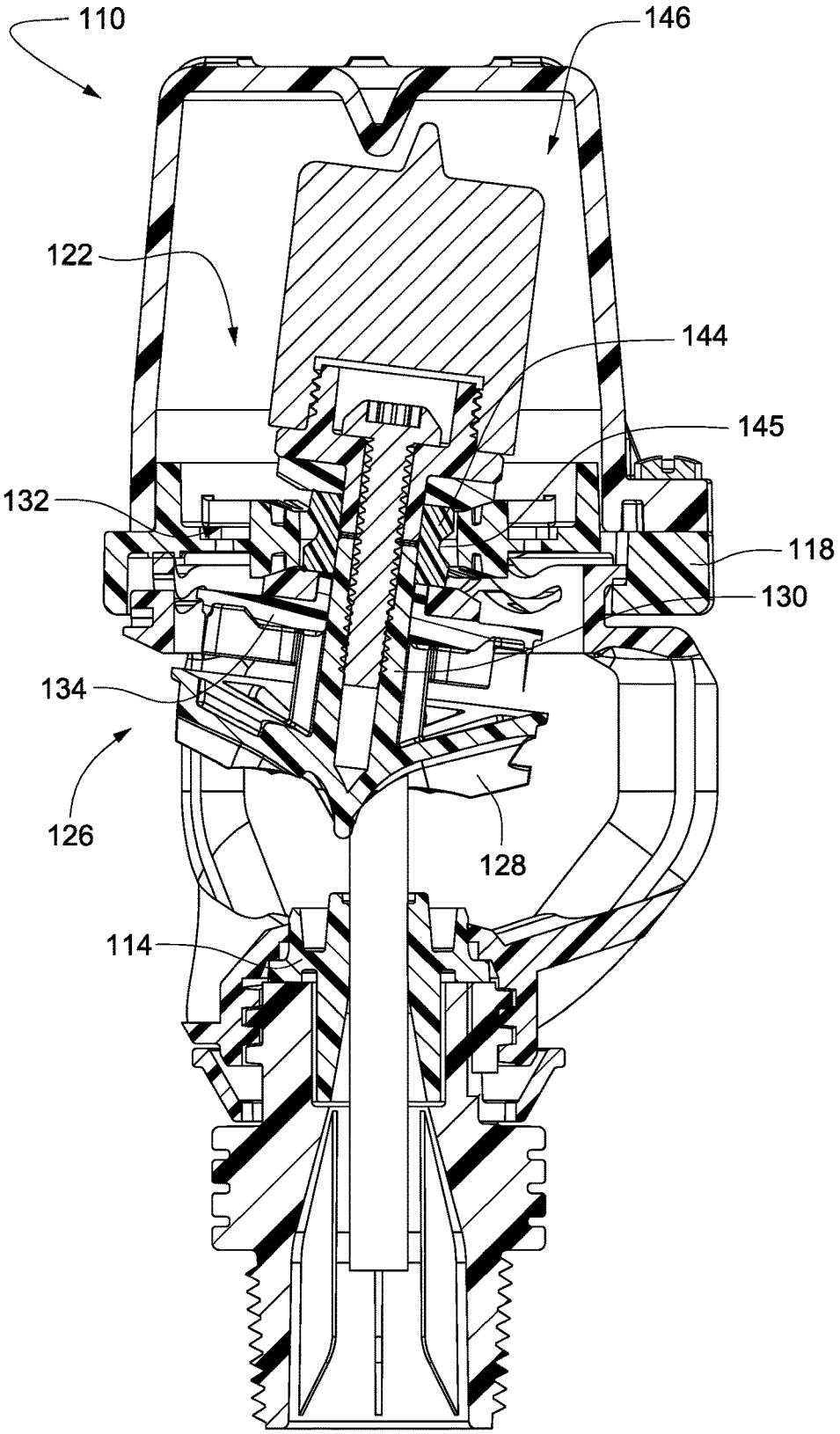
FIGS. 14 and 15 are cross-sectional views of the sprinkler head of FIG. 13.
Figure 15:
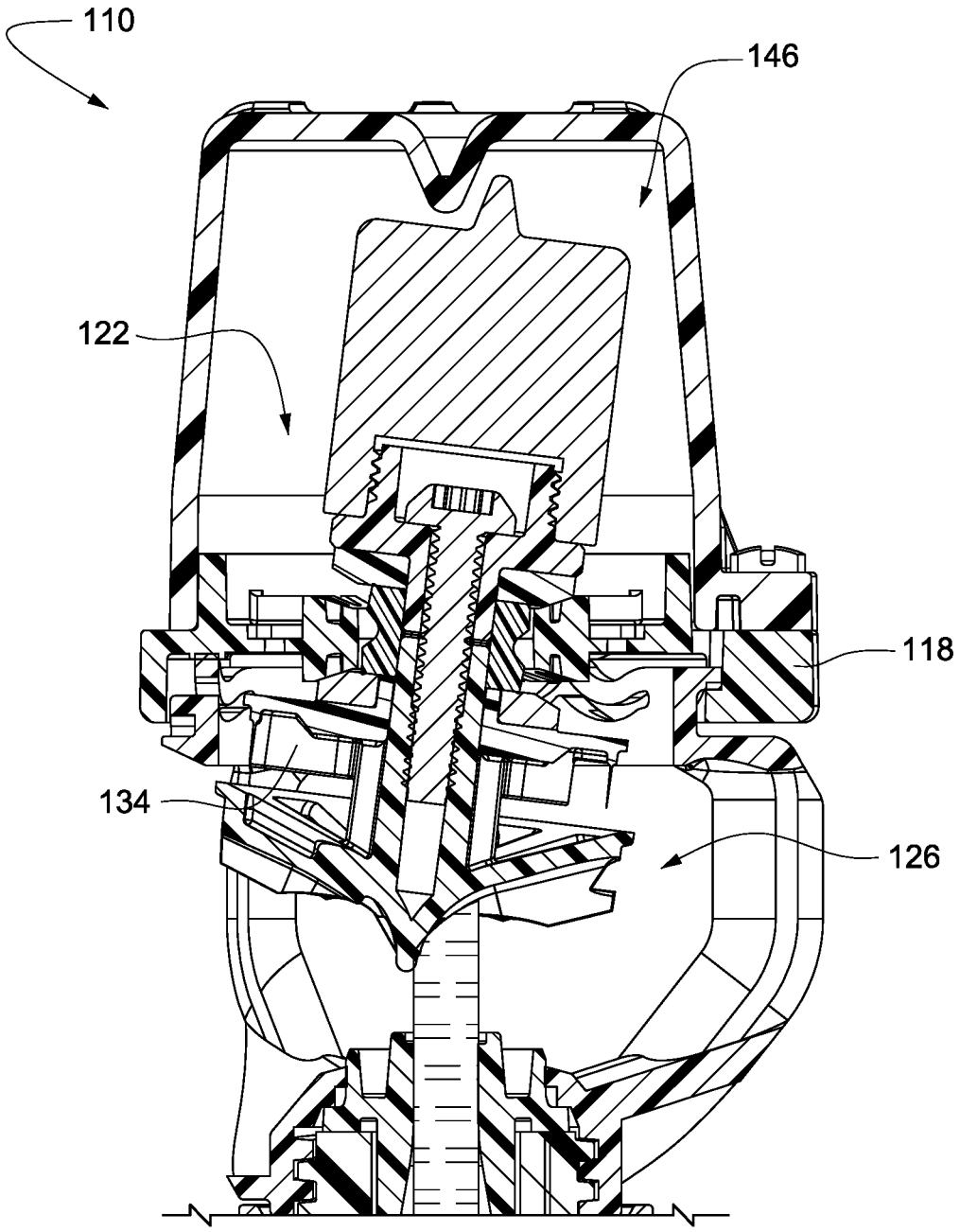
Figure 16:
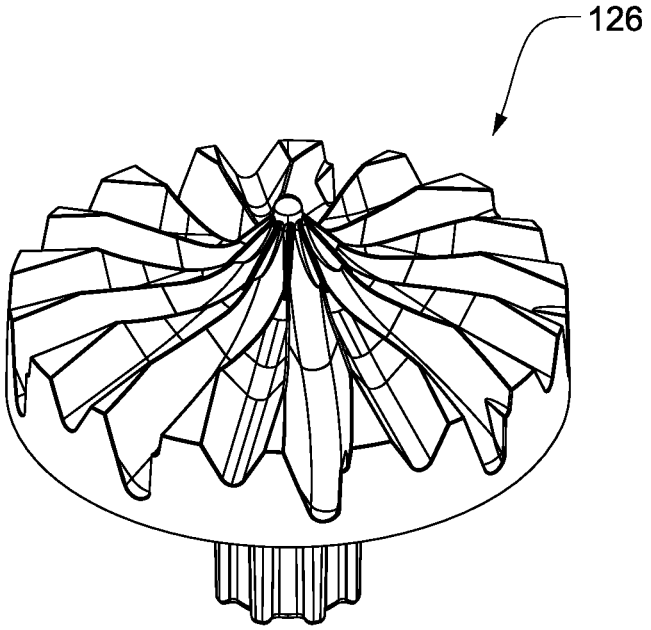
FIGS. 16-18 are perspective views of the FIG. 13 sprinkler head components.
Figure 17:
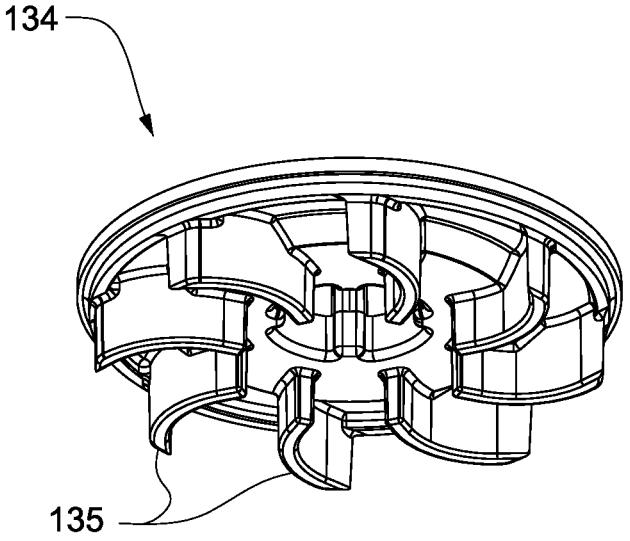

FIGS. 13-18 show a variation of the sprinkler head assembly 110. In this embodiment, the sprinkler head cover 120 is secured on the cap 118 by screws 121 or the like. As would be appreciated by those of ordinary skill in the art, this variation may be similarly applicable to the previously-described embodiments. With reference to FIGS. 14 and 15, the deflector plate assembly 122 includes a deflector plate member 126, a spool assembly 132 supported in the cap 118, and a counterbalance weight assembly 146. An upstream spool shoulder 134 defines a shield member positioned on the splined shaft 130 of the deflector plate member 126 on a downstream side of the deflector plate 128. The spool shoulder/shield member 134 includes a plurality of impeller blades/fingers 135. The blades/fingers 135 may be curved in any orientation such that the blades/fingers 135 may act as air damping impellers for damping rotation speed about both axes 66, 68 or they may act as flingers to throw residual water or drool that would normally drip in a concentrated area below the sprinkler. In either orientation, the member 134 serves to reduce the amount of abrasive particles that may reach the wear areas of the spool assembly 132 when running in sandy water conditions or the like. Sandy water from adjacent sprinklers may be deflected away from the spool assembly 132, and the blades 135 may be shaped to pull the abrasive particles and air into a hub area just above the deflector plate grooves.

Figure 18:
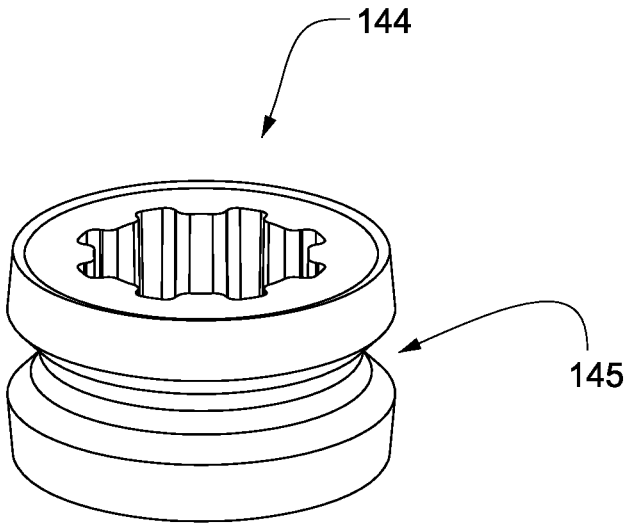

The bushing 144 may be provided with a relieved area or circumferential indentation 145 in its outside diameter (see FIG. 18). As shown, the indentation 145 may be provided in the center of the outside diameter of the bushing 144. The relieved area 145 gives sand particles and the like a place to go without jamming the spool assembly 132. Over time, debris build-up in the indentation 145 will slough off and out of the assembly due among other things to the orbital action of the deflector plate assembly 122.

In the embodiment shown in FIGS. 13-18, the tip angle of the deflector plate assembly 122 is reduced from the embodiment shown in FIG. 1 (e.g., from 10° to) 7°, and the center of motion has been shifted closer to the nozzle 114. A net effect of these adjustments is to reduce the generation of fine mist (that is blown away in the wind and becomes wasted water) and to reduce the magnitude of vibrations to thereby reduce wear on the spool components without sacrificing water distribution performance. As a result of the reduced vibration, the assembly can be balanced with less weight, which can significantly reduce manufacturing costs.

Figure 19:
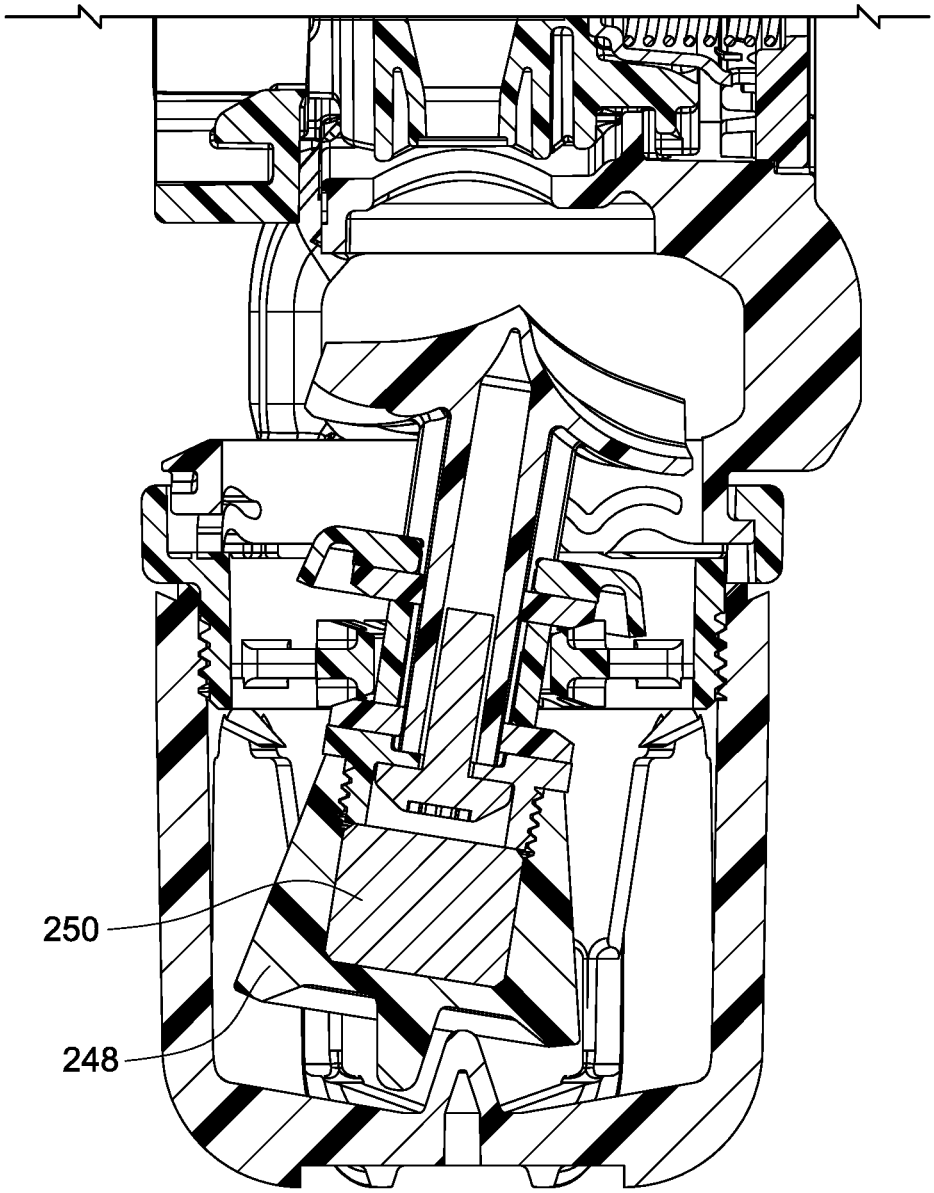
FIG. 19 shows a sprinkler head of an alternative embodiment for use on a drop tube.
Figure 20:
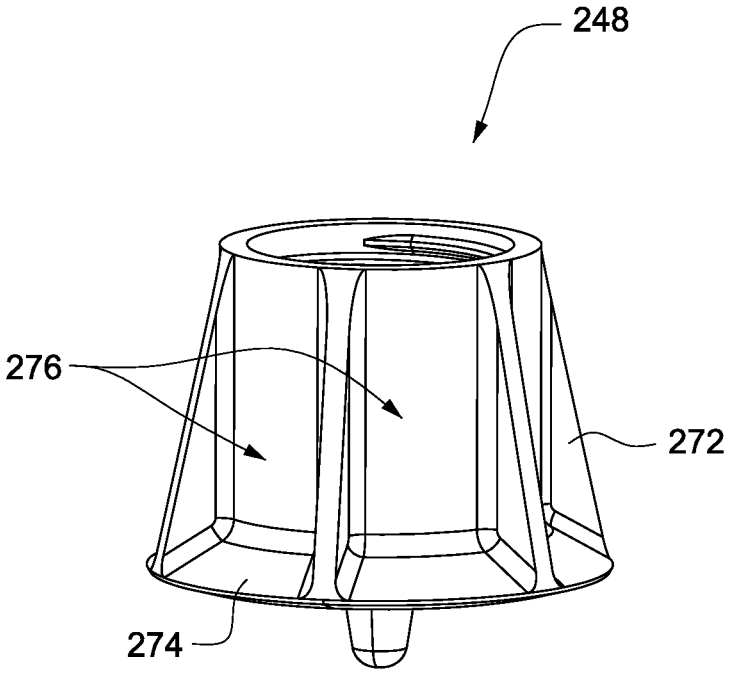
FIG. 20 is a perspective view of the counterbalance weight housing from the sprinkler head shown in FIG. 19.

FIGS. 19 and 20 show an embodiment for use on a drop tube, where the assembly is inverted such that the counterbalance weight cover or housing 248 and the counterbalance weight 250 are bottommost relative to gravity. The housing 248 includes exterior fins 272 that taper outwardly from top to bottom. The fins 272 terminate at a circumferential lip 274 such that the fins 272 and lip 274 define compartments 276 around a periphery of the housing 248. With this construction, the housing 248 acts as a flinger to catch drool and fling it away from the sprinkler rather than letting it drop in concentrated fashion directly below the unit.

Figure 21:
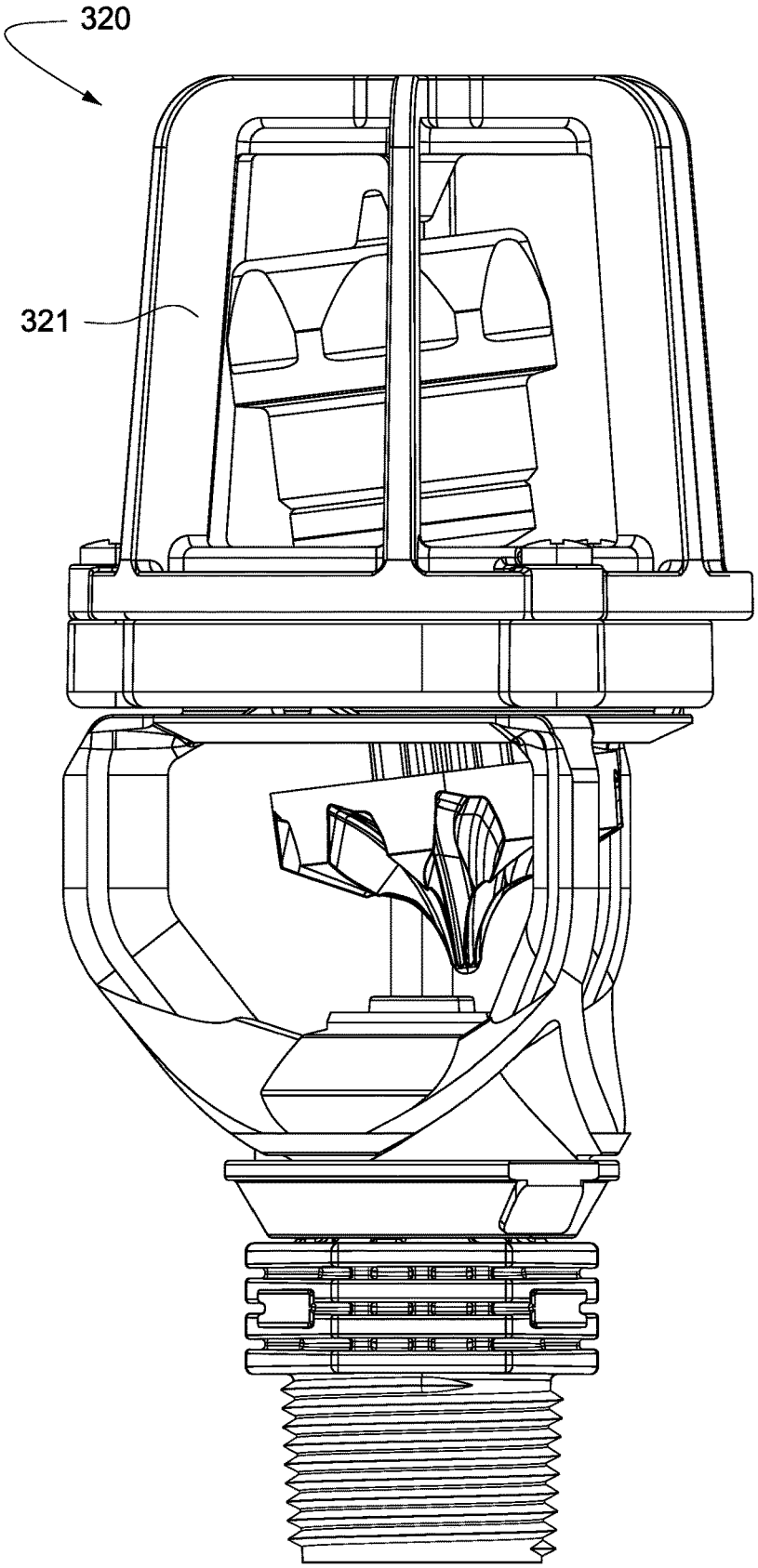
FIGS. 21-23 show a sprinkler head of another alternative embodiment.
Figure 22:
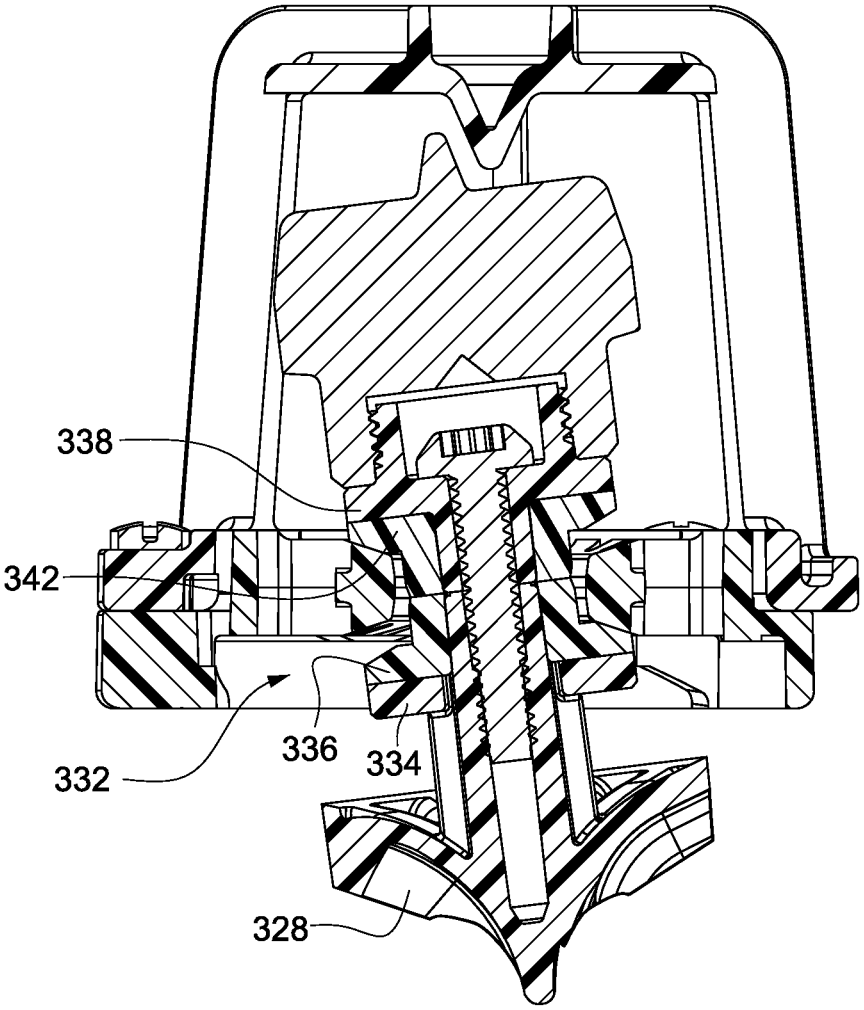
Figure 23:
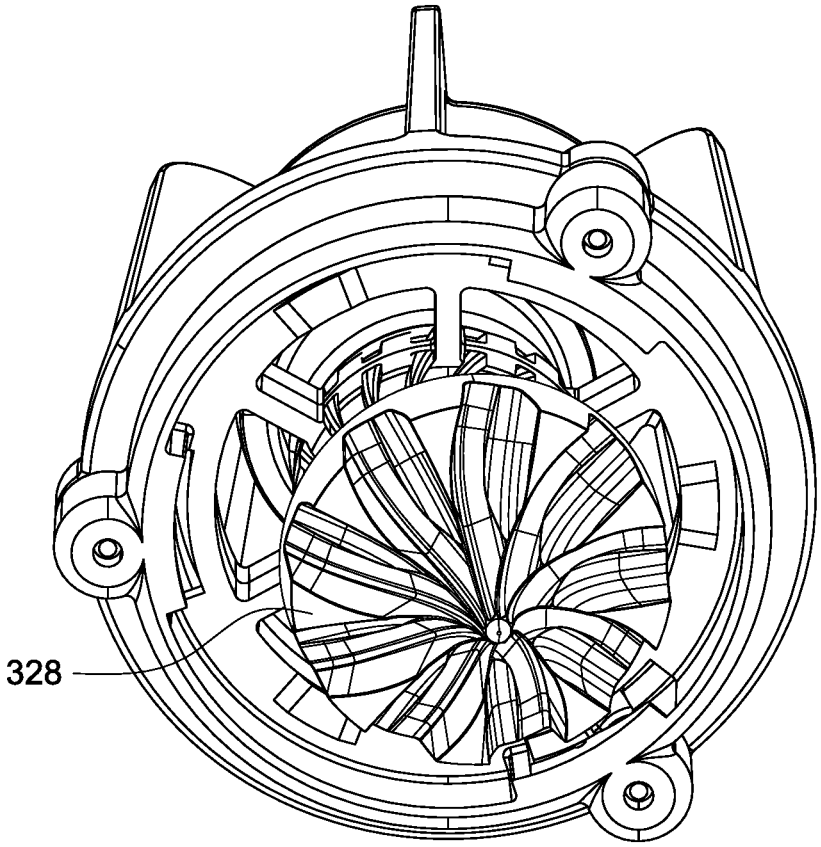

FIGS. 21-23 show an embodiment with variations to prevent insects and spiders from making nests up inside the cover. It has been discovered that spider webs for example may stall the action of the sprinkler. In this embodiment, the cover 320 has an open design with cover arms 321 to be less likely to attract spiders and insects from nesting there. Additionally, with reference to FIG. 22, the spool assembly 332 is modified to improve wear life. Specifically, the upstream and downstream flanges are separately integrated with the bushing to define an upstream flange bushing 336 abutting the upstream spool shoulder 334 and a downstream flange bushing 342 abutting the downstream spool shoulder 338. A separate bushing has been eliminated. Still further, as shown in FIG. 23, the deflector plate 328 is modified to reduce the amount of fine mist generated, add some larger droplets and increase the radius of throw. Specifically, as compared to the deflector plates of the previously-described embodiments, deflector plate 328 has fewer, but wider grooves for channeling the water, and the grooves in deflector plate 328 are elongated vertically (or axially) so the water stream is turned less abruptly as it is turned vertically.

Figure 24:
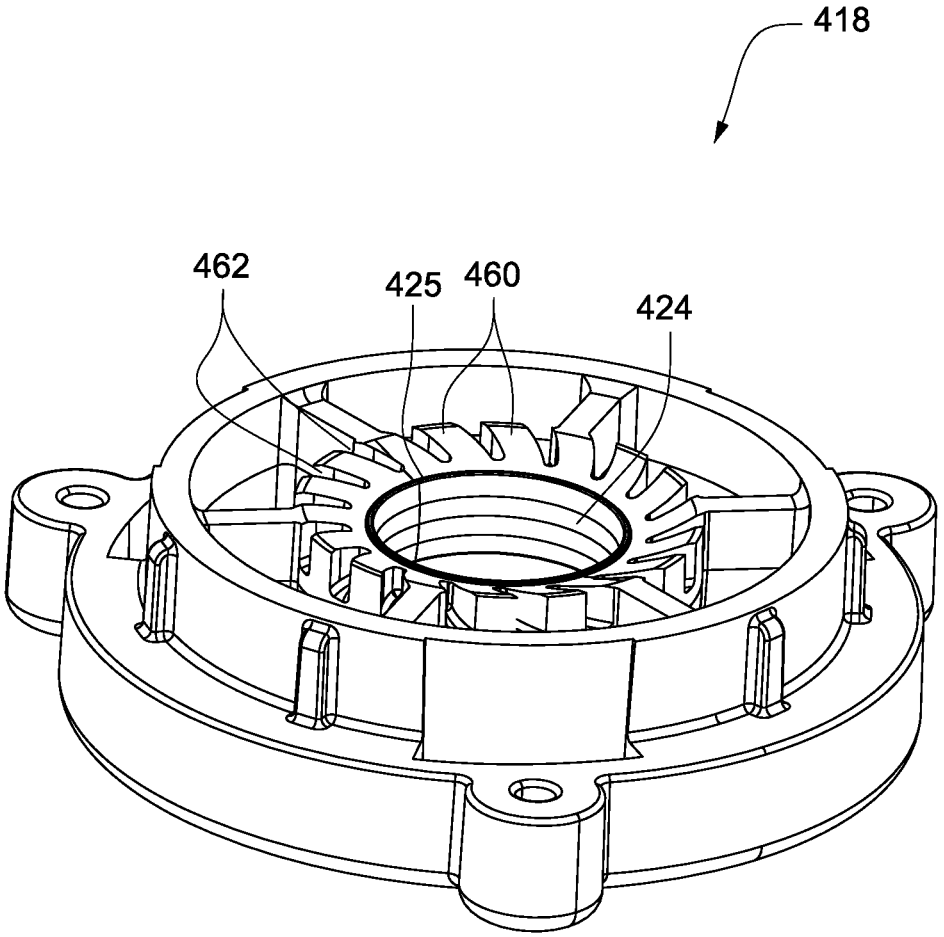
FIGS. 24-26 show an alternative cap construction with a start-up rib or lip adjacent the cap central opening.
Figure 25:
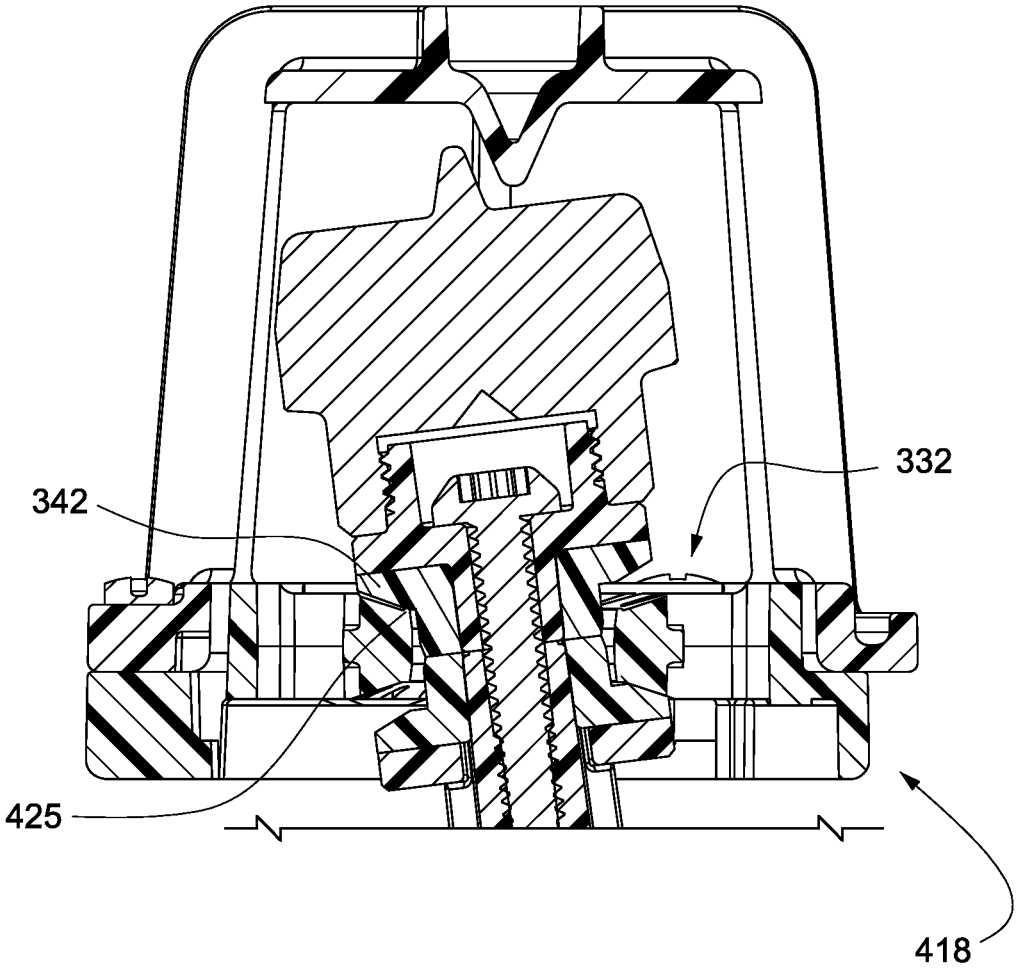
Figure 26:
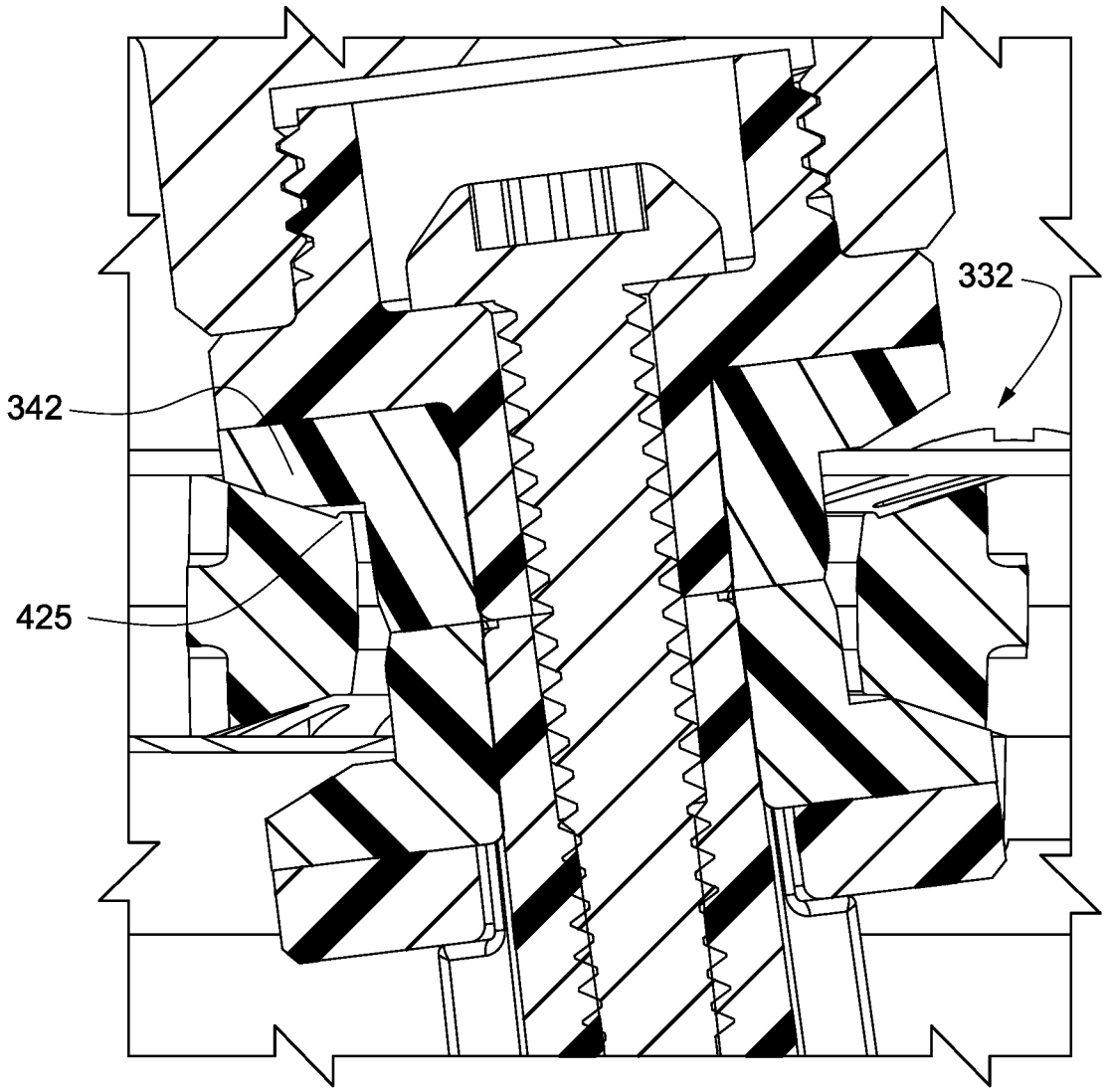

FIGS. 24-26 show an embodiment with a modified cap 418 incorporating a start-up rib or lip 425 adjacent an inside diameter of the central opening 424. FIG. 25 shows the modified cap 418 incorporated into the FIGS. 21-23 embodiment in a start-up position in which the downstream flange bushing 342 of the spool assembly 332 engages the rib or lip 425, and there is a clearance between a radially outward portion of the downstream flange bushing 342 and the traction bars 460 and debris pockets 462. FIG. 26 shows an operating position in which the downstream flange bushing 342 engages the traction bars 460 and debris pockets 462 with a clearance over the rib or lip 425. The rib or lip 425 improves start-up reliability, especially with small nozzles. The upstanding rib or lip 425 enables the spool assembly 332 to move more freely at start-up (FIG. 25), then is not contacted in the operating mode (FIG. 26).

Figure 27:
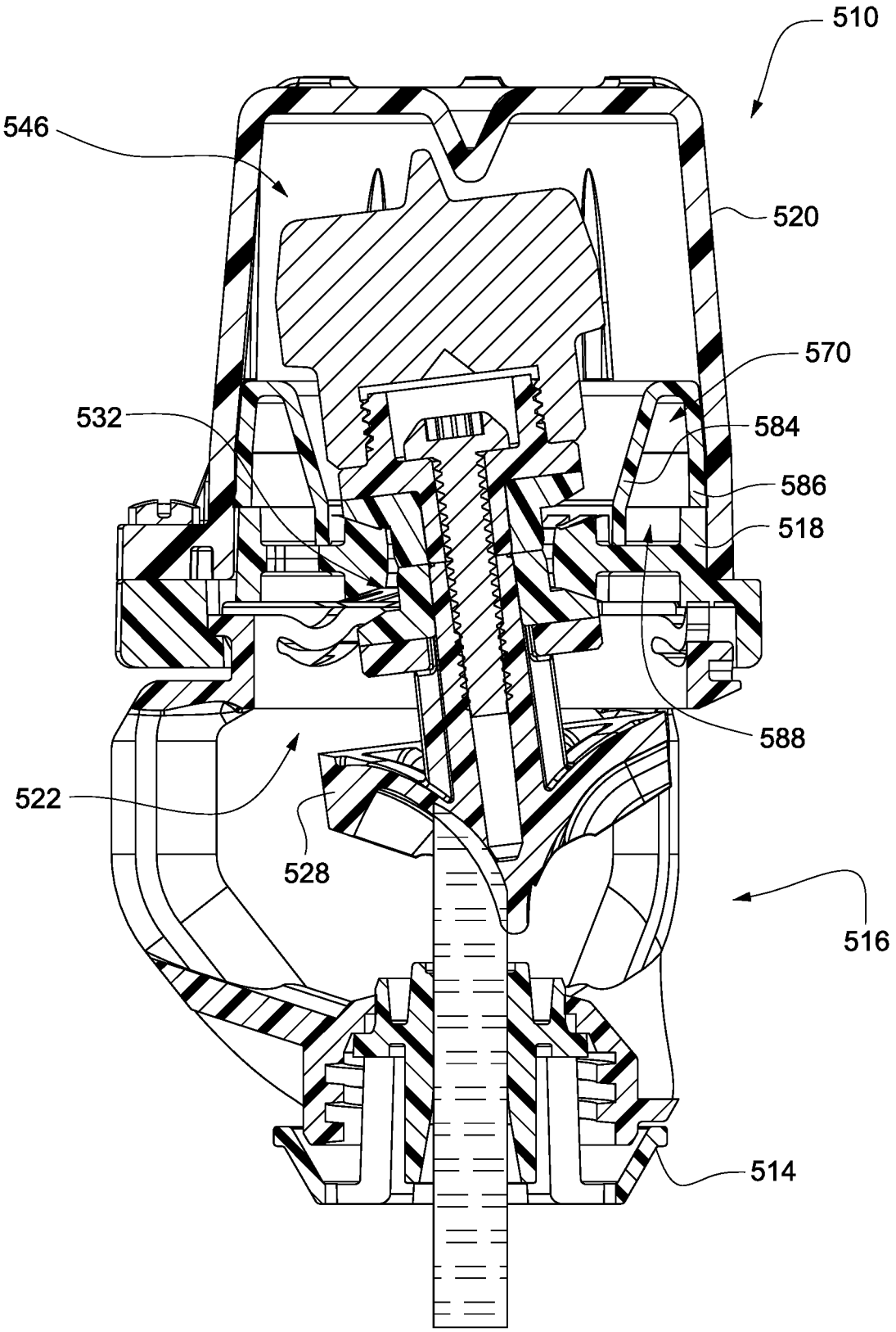
FIG. 27 shows a sprinkler head of an embodiment incorporating a spider barrier.
Figure 28:
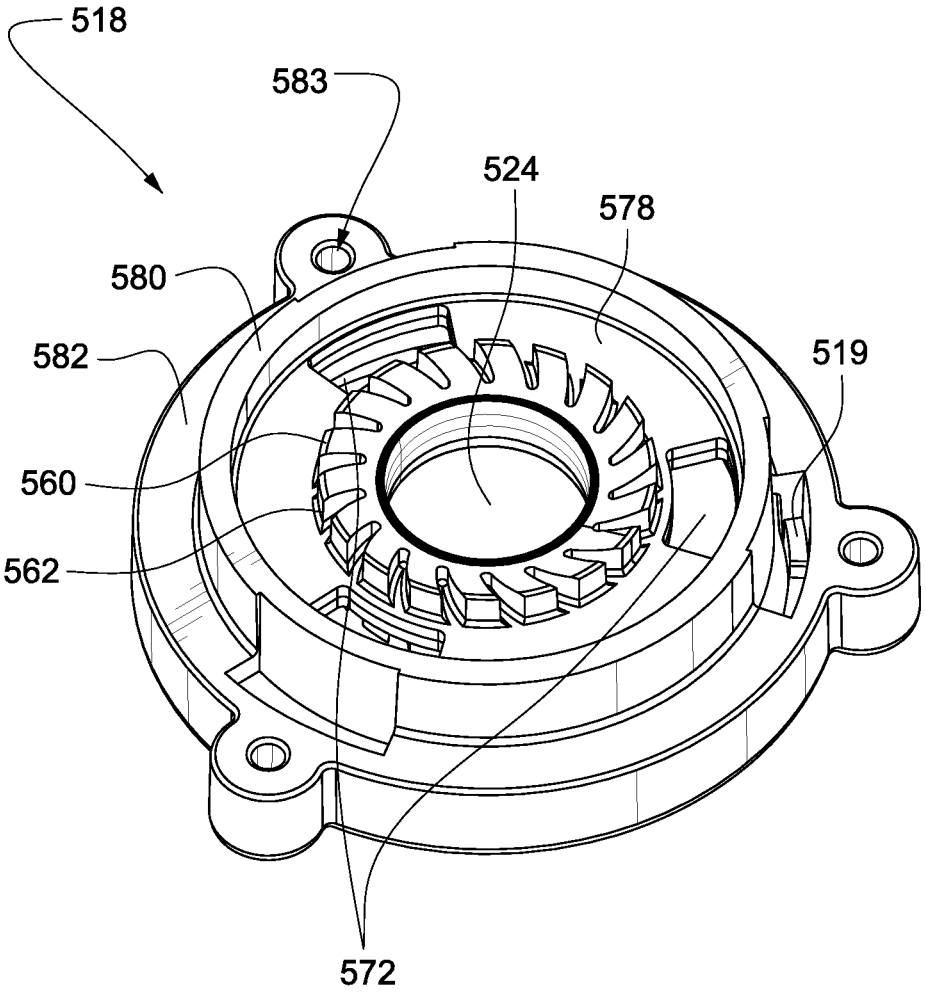
FIG. 28 is a perspective view of the cap associated with the embodiment of FIG. 27.
Figure 29:
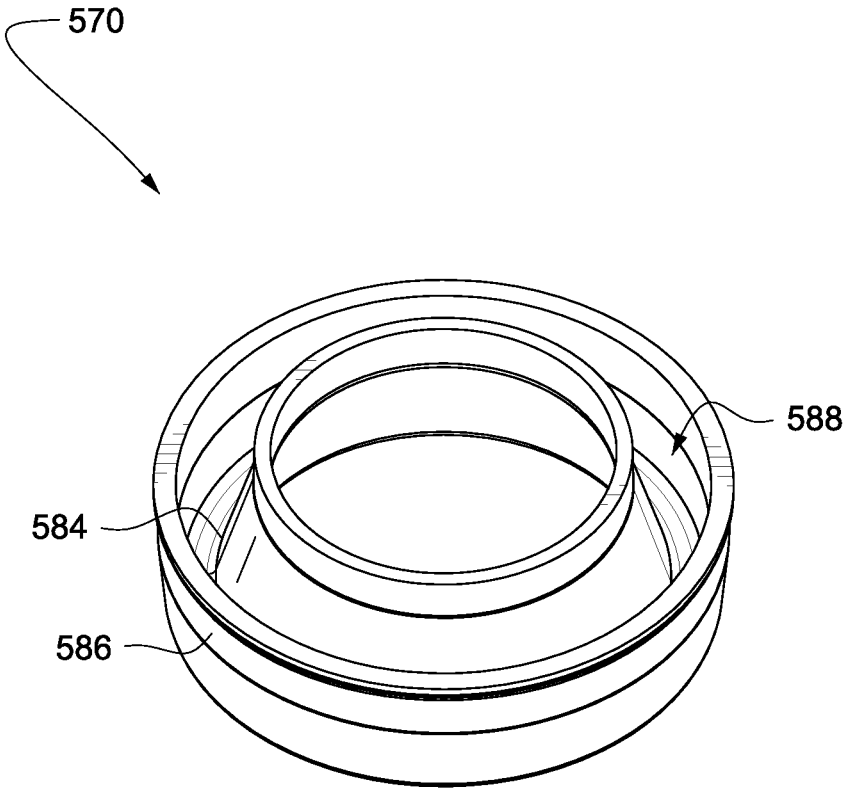
FIG. 29 is a perspective view of the spider barrier.

FIGS. 27-29 show an embodiment incorporating a spider barrier that in combination with structure surrounding the deflector plate assembly permits inevitable spider ingress while preventing spider access or contact with moving parts of the sprinkler above the cap central opening, i.e., downstream of the central opening (relative to the direction of water flow). The barrier/enclosure construction may also be effective for insects, and the structure is not meant to be limited to its application to spiders. As shown, the sprinkler head assembly 510, like previous embodiments, includes a sprinkler body 516, a nozzle 514 associated with one end of the sprinkler body 516, and a cap 518 secured to or integral with an opposite end of the sprinkler body 516. The cap 518 may also include locking structure 519 for a twist lock or bayonet-type lock to complementary components on the sprinkler body 516. A sprinkler head cover 520 is secured to the cap 518.

The cap 518 includes a central opening 524, and a deflector plate assembly 522 is supported for rotation/spinning and orbital motion in the central opening 524. Also like previous embodiments, the deflector plate assembly 522 includes a deflector plate 528 at an upstream end facing the nozzle 514, a spool assembly 532 positioned in the central opening 524 of the cap 518, and a counterbalance weight 546 at a downstream end. The sprinkler head cover 520 is positioned over the counterbalance weight 546 and secured to the cap 518.

In the embodiment shown in FIGS. 27-29, with particular reference to FIGS. 27 and 28, the cap 518, which includes traction bars 560 and debris pockets 562, includes a lower ledge 578 radially outward of the central opening 524 and an upper ledge 580 radially outward of the lower ledge 578. The cap 518 also includes one or more spider ingress openings 572 in the lower ledge 578. As shown, in a preferred construction, the cap 518 includes three spider ingress openings 572. The cap is also provided with an outer ledge 582 radially outward of the upper ledge 580. In the embodiment shown in FIG. 27, the sprinkler head cover 520 is secured to the outer ledge 582, preferably by connectors or the like through integrated connector openings 583 in the cap 518.

A spider barrier 570 is disposed in engagement with the cap 518 and defines an enclosure over the one or more spider ingress openings 572. With reference to FIGS. 27 and 29, the spider barrier 570 includes an inner circumferential wall 584 connected with an outer circumferential wall 586 with a space 588 in between. The inner wall 584 of the spider barrier 570 may engage the lower ledge 578 of the cap 518, and the outer wall 586 of the spider barrier 570 may engage the upper ledge 580 such that the space 588 between the inner and outer walls is positioned over the one or more spider ingress openings 572. As shown, the inner wall 584 may be tapered to accommodate the orbital motion of the deflector plate assembly 522. The spider barrier 570 may be substantially V-shaped in cross section.

The spider barrier 570 is thus sized and positioned to create a space for spider ingress while blocking access to moving parts of the sprinkler above the central opening 524.

The assembly shown in FIGS. 27-29 creates an enticing refuge, particularly for spiders, away from the moving parts above the central opening. The spider barrier in cooperation with the spider ingress openings serves to permit spider ingress while preventing spider access or contact with moving parts of the sprinkler above the central opening. Once inhabited, the resident spiders can chase off other potential interlopers that might otherwise be tempted to make a nest near any of the moving parts, which as noted above, could cause stalling.

The sprinkler assembly of the described embodiments provides an evenly-dispersed water pattern coupling rotation and orbital motion and may be rigidly mounted on a center pivot or other support structure. The assembly minimizes vibration, wear and drool while its construction reduces manufacturing costs. In an embodiment, the assembly accommodates spider ingress while preventing spider access to important moving parts.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A sprinkler comprising:

a sprinkler body;

a nozzle associated with one end of the sprinkler body;

a cap secured to or integral with an opposite end of the sprinkler body, the cap including a central opening and a plurality spider ingress openings through the cap positioned radially outward of the central opening, the plurality of spider ingress openings being in the form of a discrete windows, wherein the cap comprises a lower ledge radially outward of the central opening, and wherein the plurality of spider ingress openings are provided in the lower ledge;

a deflector plate assembly supported by the cap and including a deflector plate at an upstream end facing the nozzle, a spool assembly supported in the central opening of the cap, and a counterbalance weight at a downstream end, wherein the deflector plate assembly is pitched at an angle relative to the sprinkler body; and a spider barrier disposed in engagement with the cap and defining an enclosure over the plurality of spider ingress openings that blocks access to the spool assembly on a barrier side of the central opening, the lower ledge defining a floor of the enclosure.

2. A sprinkler according to claim 1, wherein the cap comprises an upper ledge radially outward of the lower ledge.

3. A sprinkler according to claim 2, wherein the spider barrier comprises an inner wall connected with an outer wall with a space in between, the inner wall engaging the lower ledge and the outer wall engaging the upper ledge such that the space between the inner and outer walls is positioned over the plurality of spider ingress openings.

4. A sprinkler according to claim 3, wherein the inner wall is tapered to accommodate orbital motion of the deflector plate assembly.

5. A sprinkler according to claim 2, further comprising a sprinkler head cover positioned over the counterbalance weight and secured to the cap.

6. A sprinkler according to claim 5, wherein the cap comprises an outer ledge radially outward of the upper ledge, and wherein the sprinkler head cover is secured to the outer ledge.

7. A sprinkler according to claim 2, wherein the plurality of spider ingress openings comprises three spider ingress openings in the lower ledge.

8. A sprinkler according to claim 1, wherein the plurality of spider ingress openings comprises three spider ingress openings.

9. A sprinkler according to claim 1, further comprising a sprinkler head cover positioned over the counterbalance weight and secured to the cap.

10. A sprinkler according to claim 1, wherein the spider barrier is substantially V-shaped in cross section.

11. A sprinkler according to claim 1, wherein the spider barrier is sized and positioned to create a space while blocking access to moving parts of the sprinkler on a downstream side of the cap.

12. A sprinkler comprising:

a sprinkler body having a longitudinal axis;

a cap secured to or integral with the sprinkler body and including a central opening and a plurality of spider ingress openings through the cap positioned radially outward of the central opening, the plurality of spider ingress openings being in the form of discrete windows, wherein the cap comprises a lower ledge radially outward of the central opening, and wherein the plurality of spider ingress openings is provided in the lower ledge;

a nozzle; and a deflector plate assembly including a deflector plate at one end disposed facing the nozzle, a counterbalance weight disposed at an opposite end, and a spool assembly positioned in the central opening and disposed between the deflector plate and the counterbalance weight; and a spider barrier disposed in engagement with the cap and defining an enclosure over the plurality of spider ingress openings that blocks access to the spool assembly on a barrier side of the central opening, the lower ledge defining a floor of the enclosure, wherein the deflector plate assembly is rotatable about a rotation axis, and wherein the deflector plate assembly is supported in the sprinkler body such that the rotation axis is pitched relative to the longitudinal axis and such that the deflector plate assembly is configured to wobble about the longitudinal axis.

13. A sprinkler according to claim 12, wherein the cap comprises an upper ledge radially outward of the lower ledge.

14. A sprinkler according to claim 13, wherein the spider barrier comprises an inner wall connected with an outer wall with a space in between, the inner wall engaging the lower ledge and the outer wall engaging the upper ledge such that the space between the inner and outer walls is positioned over the plurality of spider ingress openings.

15. A sprinkler according to claim 14, wherein the inner wall is tapered.

16. A sprinkler according to claim 13, wherein the plurality of spider ingress openings comprises three spider ingress openings in the lower ledge.

17. A sprinkler according to claim 12, wherein the plurality of spider ingress openings comprises three spider ingress openings.

18. A sprinkler according to claim 12, wherein the spider barrier is sized and positioned to create a space while blocking access to moving parts of the sprinkler on a downstream side of the cap.

19. A sprinkler according to claim 12, wherein the spider barrier is shaped to accommodate the wobble of the deflector plate assembly about the longitudinal axis.

* * * * *